US011180953B2

(12) United States Patent
Snader et al.

(10) Patent No.: US 11,180,953 B2
(45) Date of Patent: Nov. 23, 2021

(54) VISUAL SECURITY AND ENVIRONMENTAL SELF ADJUSTING WINDOW

(71) Applicant: WINCO Window Company, Inc., St. Louis, MO (US)

(72) Inventors: Kenneth Snader, St. Louis, MO (US); Gantt Miller, III, Minden, NV (US); Gantt Miller, IV, S. Lake Tahoe, NV (US); Lothar Erkens, Edwardsville, IL (US); Dennis Brosch, St. Louis, MO (US)

(73) Assignee: WINCO Window Company, Inc., St. Louis, MO (US)

( * ) Notice: Subject to any disclaimer, the term of this patent is extended or adjusted under 35 U.S.C. 154(b) by 272 days.

(21) Appl. No.: 16/395,937

(22) Filed: Apr. 26, 2019

(65) Prior Publication Data

US 2020/0340299 A1 Oct. 29, 2020

(51) Int. Cl.

| | |
|---|---|
| ***E06B 9/42*** | (2006.01) |
| ***E06B 9/68*** | (2006.01) |
| ***E06B 3/67*** | (2006.01) |
| ***E06B 3/26*** | (2006.01) |
| *E04B 2/88* | (2006.01) |

(52) U.S. Cl.

CPC ..... *E06B 9/42* (2013.01); *E06B 3/26* (2013.01); *E06B 3/6722* (2013.01); *E06B 9/68* (2013.01); *E04B 2/88* (2013.01); *E06B 2009/6809* (2013.01)

(58) Field of Classification Search

CPC . E06B 3/42; E06B 3/26; E06B 3/6722; E06B 9/68; E06B 3/66328; E06B 9/264; E04B 2/88

USPC ..... 160/98, 107

See application file for complete search history.

(56) References Cited

U.S. PATENT DOCUMENTS

| | | | | |
|---|---|---|---|---|
| 3,253,644 A * | 5/1966 | Gotoh | E06B 9/264 | 160/107 |
| 5,048,245 A * | 9/1991 | Bresson | E06B 9/264 | 52/171.3 |
| 5,600,920 A * | 2/1997 | Roy | E06B 9/264 | 160/107 |
| 5,699,845 A * | 12/1997 | Jelic | E06B 9/264 | 160/107 |

(Continued)

*Primary Examiner* — Beth A Stephan
(74) *Attorney, Agent, or Firm* — Lewis Rice LLC

(57) ABSTRACT

A smart window including a motorized shade is provided, particularly where the smart window includes a frame portion having a first subframe and a second subframe for mounting the smart window and routing the motor wirings. In a described embodiment, the smart window comprises: a frame portion including a wiring chase positioned internal to the frame portion and a glass portion. The glass portion may comprise a motorized shade, the motorized shade including a motor, a motor wiring, and a shade roll; a first pane of glass attached to the frame portion on an exterior side of the smart window; and a second pane of glass attached to the frame portion on an interior side of the smart window; wherein the frame portion surrounds the glass portion, wherein the motorized shade is attached to the frame portion between the first pane of glass and the second pane of glass by a hanging system, and wherein the motor wiring is positioned internal to the frame portion and the wiring chase.

7 Claims, 5 Drawing Sheets

(56) References Cited

U.S. PATENT DOCUMENTS 5,769,142 A * 6/1998 Nicolosi ..... E06B 9/264 160/107
6,059,006 A * 5/2000 Rossini ..... E06B 9/264 160/107
6,070,638 A * 6/2000 Jelic ..... E06B 9/264 160/107
6,397,917 B1 * 6/2002 Levert ..... E06B 9/264 160/107
6,601,633 B2 * 8/2003 Sun ..... E06B 9/264 160/107
7,191,817 B2 * 3/2007 Nicolosi ..... E06B 9/264 160/84.06
7,201,205 B2 * 4/2007 Lyness ..... E06B 9/264 160/107
7,234,501 B1 * 6/2007 Park ..... E06B 9/264 160/107
7,669,633 B2 * 3/2010 Berger ..... E06B 3/04 160/107
7,681,618 B2 * 3/2010 Nicolosi ..... E06B 9/264 160/98
7,938,162 B2 * 5/2011 Duineveld ..... E06B 9/64 160/121.1
8,347,937 B2 * 1/2013 Murphy ..... E06B 9/262 160/84.04
8,616,260 B2 * 12/2013 Zhang ..... E06B 9/264 160/107
8,678,069 B2 * 3/2014 Choi ..... H02S 30/20 160/107
9,255,442 B2 * 2/2016 Nicolosi ..... E06B 3/66309
9,359,815 B2 * 6/2016 Nicolosi ..... E06B 9/264
2003/0075285 A1 * 4/2003 Anderson ..... E06B 9/264 160/90
2004/0011476 A1 * 1/2004 Schroder ..... E06B 9/264 160/107
2004/0069417 A1 * 4/2004 Sun ..... E06B 9/304 160/107
2016/0322817 A1 * 11/2016 Baker ..... G05B 15/02
2019/0085618 A1 * 3/2019 Kassas ..... E04B 2/967

* cited by examiner

VISUAL SECURITY AND ENVIRONMENTAL SELF ADJUSTING WINDOW

BACKGROUND OF THE INVENTION

1. Field of the Invention

This disclosure is related to the field of commercial windows. More particularly to smart windows that utilize internal, motorized shades for security and environmental protection and subframes having a wiring chase for electrical wiring.

2. Description of the Related Art

Buildings have included windows for thousands of years. Windows are an opening made in something that would otherwise be impenetrable—windows have been placed into the walls and roofs of buildings to facilitate the flow of light and air into the building's interior. At first, windows were made as an opening in an otherwise complete structure. These first windows may have been covered by animal hide, cloth, or wood when not in use. Eventually, building designers began to use glass as a covering, which allowed light to enter the building while blocking weather and wind. Glass making techniques improved over time, and today entire facades of skyscrapers may be formed of glass panes and aluminum or steel mullions. Further, multiple panes of glass may be used to improve thermal and sound insulation provided by the windows.

Glass windows have included interior blinds, curtains, and shades to allow the building's occupant to control the amount of light entering the building's interior. Additionally, interior blinds, curtains, and shades contribute to the aesthetics of the building's interior. Typically, curtains are pieces of cloth or another textile and may be mounted on a pole above a window on a building's interior. Blinds are, generally, composed of several long horizontal or vertical slats of various types of hard material. A shade is, generally, a collection of material that may be rolled around a central dowel or other tubular support to allow the shade to be opened and closed in an efficient manner. Unlike blinds, the material of a shade is, generally, continuous. The first shades were manually unfurled (closed) and rolled up (opened). Today, there are motorized shades that may be opened and closed via a remote control.

In some instances, a motorized shade may be mounted between two panes of glass or other window material. In this case, the window will have one exterior pane of glass that separates the motorized shade from the exterior of the building. The window would also have an interior pane of glass that separates the motorized shade from the interior of the building. This arrangement—the motorized shade being between two panes of glass—allows the motorized shade to be protected from both the interior and exterior of the building. Further, the window and shade may be designed as a single unit, allowing for better integration of the motorized shade into the window. One issue that has plagued these prior windows with two panes of glass and a motorized shade has been the process of wiring the motor of the motorized shade to the building's electrical grid so that the motor may receive the power it needs to work.

Traditionally, window design and shade design activities have been divided tasks. Window designers are not typically also window blind designers, and vice versa. Accordingly, integration of blind designs into or with window designs has been limited, at best. This has led to an overall lack of efficiency and integration of blind designs into window designs used in buildings. For example, motorized designs for window shades and the wiring associated therewith have not been fully integrated into the windows themselves. This has led to windows that include inefficient and costly wiring procedures for motorized shades.

Today, windows including wiring for electrical components do not have a modular or consistent way to connect the wiring to a building's electrical grid. For example, the wiring from the motor of the motorized shade is typically routed through holes in the frame of a related window or even though holes in the panes of glass of the window. This may reduce the structural integrity of the panes of glass, and also may require unattractive gaskets to ensure that water and weather do not interfere with the motor and shade. Further, wiring through holes in the frame may require window installers to drill holes in the window frame, potentially causing problems with the window frame or altering the aesthetics of the window.

Typically, buildings have access to their electrical grid within the walls of the building. Windows that require a connection to this electrical grid then must extend wires from the window to a portion of the building's interior walls that include connection points to the electrical grid. In some instances, the wiring must extend through the window frame or glass to reach into the buildings walls to connect to the building's electrical grid. In other instances, the wiring travels along the interior of the window frame or glass panel and out of a portion of the window frame into the building's walls. In each case, the resulting wiring is relatively disorganized and often inaccessible after installation. This makes rewiring more difficult, as well as maintenance and repairs, because the wiring is inaccessible.

Further, wiring such windows during installation is inefficient because each window must be individually wired into the building's electrical grid, which may not always be in a convenient location. Further, in the case of a large number of windows on a building's wall, the corresponding large number of connections may be inconvenient or difficult to wire into the building's electrical grid. When the window wirings are not coordinated, many different connections may need to be routed within the building's walls and individually connected to the building's electrical grid. This process is difficult to manage properly, time consuming, and difficult to maintain once installed. Further, this process is very difficult to update at a later time because it is disorganized and the wiring is hidden behind the building's walls.

Moreover, in much of the United States, many regulations cover and control how windows are designed and installed into buildings. For example, a number of regulations may apply to windows that include electrical components, especially if the electrical wiring is considered by regulators to extend through the building's external walls from the exterior of the building to the interior. In these situations, windows must have their electrical components and related wiring certified by various agencies or third parties and must comply with all regulations. Some prior windows having motorized shades only included one pane of glass with the motorized shades being mounted on the interior frame portion of the window. In this case, the wirings would generally be considered to be on the interior of the building. However, when there is a motorized shade between two panes of glass, the method of wire routing may determine what regulators will consider being interior and exterior routing. Accordingly, there are advantages to wirings that are considered by regulators to be interior routing.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a smart window having a motorized shade and a subframe, which is designed to provide a wiring chase for efficient and organized wiring paths for the wiring of the motorized shade.

In an embodiment, described herein, among other things, a smart window may comprise: a frame portion including a wiring chase positioned internal to the frame portion and a glass portion. The glass portion may comprise a motorized shade, the motorized shade including a motor, a motor wiring, and a shade roll; a first pane of glass attached to the frame portion on an exterior side of the smart window; and a second pane of glass attached to the frame portion on an interior side of the smart window; wherein the frame portion surrounds the glass portion, wherein the motorized shade is attached to the frame portion between the first pane of glass and the second pane of glass by a hanging system, and wherein the motor wiring is positioned internal to the frame portion and the wiring chase.

In an embodiment of the smart window, the smart window may further comprise a wiring chase cover, wherein the wiring chase includes at least one opening on an a surface distal from the glass portion that is covered by the wiring chase cover.

In an embodiment of the smart window, at least one of the first pane of glass and the second pane of glass is made from a laminated material.

In an embodiment of the smart window, the frame portion comprises a first subframe and a second subframe, wherein the second subframe surrounds the first subframe, and wherein the wiring chase is positioned internal to the second subframe portion.

In an embodiment of the smart window, the first pane of glass and the second pane of glass are both attached to the first subframe.

In an embodiment of the smart window, the smart window further comprises a second smart window comprising a second frame portion including a second wiring chase positioned internal to the second frame portion and a second glass portion comprising. The second glass portion comprises a second motorized shade, the second motorized shade including a second motor, a second motor wiring, and a second shade roll; a third pane of glass attached to the second frame portion on an exterior side of the second smart window; and a fourth pane of glass attached to the second frame portion on an interior side of the second smart window, wherein the second frame portion surrounds the second glass portion, wherein the second motorized shade is attached to the second frame portion between the third pane of glass and the fourth pane of glass by a second hanging system, and wherein the second motor wiring is positioned internal to the second frame portion and the second wiring chase, wherein the smart window is installed in a building at a position adjacent to the second smart window, and wherein the motor wiring is positioned internal to the wiring chase and the second wiring chase.

In an embodiment of the smart window, the smart window further comprises a control panel configured to control the motorized shade and the second motorized shade simultaneously.

In another embodiment of a smart window, the smart window is configured for retrofitting a previously installed window and comprises a frame portion including a wiring chase positioned internal to the frame portion and a glass portion. The glass portion comprises a motorized shade, the motorized shade including a motor, a motor wiring, and a shade roll; and a first pane of glass attached to the frame portion on an interior side of the smart window, the interior side of the smart window being opposite to an exterior side of the smart window, wherein the frame portion surrounds the glass portion, wherein the motorized shade is attached to the frame portion between the first pane of glass and the exterior side of the smart window by a hanging system, and wherein the motor wiring is positioned internal to the frame portion and the wiring chase.

In an embodiment of the smart window, the smart window further comprises a wiring chase cover, wherein the wiring chase includes at least one opening on an a surface distal from the glass portion that is covered by the wiring chase cover.

In an embodiment of the smart window, the first pane of glass is made from a laminated material.

In an embodiment of the smart window, the frame portion further comprises a first subframe, and the wiring chase is provided external to the first subframe portion.

In an embodiment of the smart window, the smart window further comprises a second smart window configured for retrofitting a previously installed window comprising: a second frame portion including a second wiring chase positioned internal to the second frame portion; and a second glass portion. The second glass portion comprises a second motorized shade, the second motorized shade including a second motor, a second motor wiring, and a second shade roll; and a second pane of glass attached to the frame portion on an interior side of the second smart window, the interior side of the second smart window being opposite to an exterior side of the second smart window, wherein the second frame portion surrounds the second glass portion, wherein the second motorized shade is attached to the second frame portion between the second pane of glass and the exterior side of the smart window by a hanging system, and wherein the second motor wiring is positioned internal to the second frame portion and the second wiring chase, wherein the smart window is installed in a building at a position adjacent to the second smart window, and wherein the motor wiring is positioned internal to the wiring chase and the second wiring chase.

In another embodiment of the smart window, there is provided a method for installing a retrofitted smart window on an interior side of a previously installed pane of glass, the method comprising: providing a smart window, the smart window comprising: a frame portion including a wiring chase positioned internal to the frame portion; and a glass portion comprising: a motorized shade, the motorized shade including a motor, a motor wiring, and a shade roll; and a first pane of glass attached to the frame portion on an interior side of the smart window; wherein the frame portion surrounds the glass portion, and wherein the motorized shade is attached to the frame portion between the first pane of glass and previously installed pane of glass by a hanging system;

attaching the smart window to a frame of the previously installed pane of glass so that the motorized shade is located between the previously installed pane of glass and the first pane of glass; and connecting the motor wiring from the wiring chase to an electrical grid, wherein the motor wiring is positioned internal to the frame portion and the wiring chase.

DETAILED DESCRIPTION OF THE PREFERRED EMBODIMENT(S)

Figure 1:
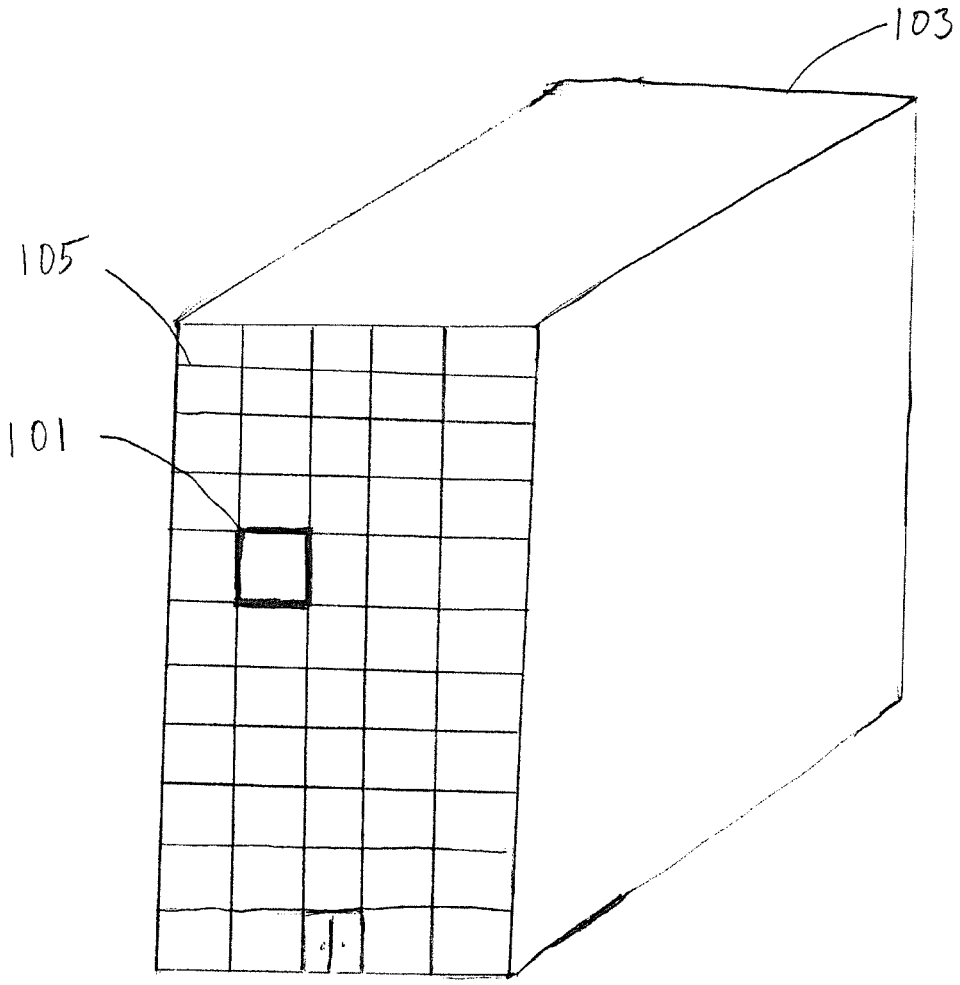
FIG. 1 depicts an embodiment of a smart window installed in a curtain wall of a building.

This disclosure is focused on a smart window having in internal, motorized shade and a subframe, as well as methods of using the same. The smart windows particularly assist in the thermal and visual regulation of the related interior space. Further, the subframe of the smart windows assist in the installation, adjustment, and maintenance of the smart windows' electrical systems.

FIGS. 1 through 5 herein illustrate embodiments of a smart window and a subframe providing an included wiring chase. The subframe wiring chase may provide organized wiring paths for the wiring of the motorized shade. This allows for efficient installation of the smart window and its motorized shade. This can allow adjacent smart windows to share a wiring path, and may also allow for more efficient wiring of multiple adjacent windows during installation. Depending on the embodiment, the smart window's subframe may also provide easy and safe access to the wiring of the motorized shade after installation of the smart window. This allows for efficient and convenient maintenance of the wiring for the motorized shade and also allows for efficient and convenient upgrades to the wiring for easy rewiring of the motorized shades. The smart window's subframe may also provide a means for installing smart windows having electrical components where regulators will consider the electrical components to be mounted and wired entirely within the building, effectively avoiding regulations for electrical components that are wired between the exterior and interior of the building.

Throughout this disclosure, the term "computer" describes hardware, which generally implements functionality provided by digital computing technology, particularly computing functionality associated with microprocessors. The term "computer" is not intended to be limited to any specific type of computing device, but it is intended to be inclusive of all computational devices including, but not limited to: processing devices, microprocessors, personal computers, desktop computers, laptop computers, workstations, terminals, servers, clients, portable computers, handheld computers, smart phones, tablet computers, mobile devices, server farms, hardware appliances, minicomputers, mainframe computers, video game consoles, handheld video game products, and wearable computing devices including, but not limited to eyewear, wristwear, pendants, and clip-on devices.

As used herein, a "computer" is necessarily an abstraction of the functionality provided by a single computer device outfitted with the hardware and accessories typical of computers in a particular role. By way of example and not limitation, the term "computer" in reference to a laptop computer would be understood by one of ordinary skill in the art to include the functionality provided by pointer-based input devices, such as a mouse or track pad, whereas the term "computer" used in reference to an enterprise-class server would be understood by one of ordinary skill in the art to include the functionality provided by redundant systems, such as RAID drives and dual power supplies.

It is also well known to those of ordinary skill in the art that the functionality of a single computer may be distributed across a number of individual machines. This distribution may be functional, as where specific machines perform specific tasks; or, balanced, as where each machine is capable of performing most or all functions of any other machine and is assigned tasks based on its available resources at a point in time. Thus, the term "computer" as used herein, can refer to a single, standalone, self-contained device or to a plurality of machines working together or independently, including without limitation: a network server farm, "cloud" computing system, software-as-a-service, or other distributed or collaborative computer networks.

Those of ordinary skill in the art also appreciate that some devices that are not conventionally thought of as "computers" nevertheless exhibit the characteristics of a "computer" in certain contexts. Where such a device is performing the functions of a "computer" as described herein, the term "computer" includes such devices to that extent. Devices of this type include but are not limited to: network hardware, print servers, file servers, NAS and SAN, load balancers, and any other hardware capable of interacting with the systems and methods described herein in the matter of a conventional "computer."

For purposes of this disclosure, there will also be significant discussion of a special type of computer referred to as a "mobile device". A mobile device may be, but is not limited to, a smart phone, tablet PC, e-reader, or any other type of mobile computer. Generally speaking, the mobile device is network-enabled and communicating with a server system providing services over a telecommunication or other infrastructure network. A mobile device is essentially a mobile computer, but one that is commonly not associated with any particular location, is also commonly carried on a user's person, and usually is in real-time or near real-time communication with a network.

Throughout this disclosure, the term "software" refers to code objects, program logic, command structures, data structures and definitions, source code, executable and/or binary files, machine code, object code, compiled libraries, implementations, algorithms, libraries, or any instruction or set of instructions capable of being executed by a computer processor, or capable of being converted into a form capable of being executed by a computer processor, including without limitation virtual processors, or by the use of run-time environments, virtual machines, and/or interpreters. Those of ordinary skill in the art recognize that software can be wired or embedded into hardware, including without limitation onto a microchip, and still be considered "software" within the meaning of this disclosure. For purposes of this disclosure, software includes without limitation: instructions stored or storable in RAM, ROM, flash memory BIOS, CMOS, mother and daughter board circuitry, hardware controllers, USB controllers or hosts, peripheral devices and controllers, video cards, audio controllers, network cards, Bluetooth® and other wireless communication devices, virtual memory, storage devices and associated controllers, firmware, and device drivers. The systems and methods described here are contemplated to use computers and computer software typically stored in a computer- or machine-readable storage medium or memory.

Throughout this disclosure, the term "network" generally refers to a voice, data, or other telecommunications network over which computers communicate with each other. The term "server" generally refers to a computer providing a service over a network, and a "client" generally refers to a computer accessing or using a service provided by a server over a network. Those having ordinary skill in the art will appreciate that the terms "server" and "client" may refer to hardware, software, and/or a combination of hardware and software, depending on context. Those having ordinary skill in the art will further appreciate that the terms "server" and "client" may refer to endpoints of a network communication or network connection, including but not necessarily limited to a network socket connection. Those having ordinary skill in the art will further appreciate that a "server" may comprise a plurality of software and/or hardware servers delivering a service or set of services. Those having ordinary skill in the art will further appreciate that the term "host" may, in noun form, refer to an endpoint of a network communication or network (e.g. "a remote host"), or may, in verb form, refer to a server providing a service over a network ("hosts a website"), or an access point for a service over a network.

FIG. 1 provides an embodiment of a smart window (101). The smart window (101) is located in an exterior wall of a building (103). The exterior wall in this case is a curtain wall (105) formed almost entirely of smart windows (101). In the case of a curtain wall (105), the interior of the building (103) generally supports the loading of the building (103). The curtain wall (105) then supports the loading of the curtain wall (105) itself. In the embodiment depicted in FIG. 1, the curtain wall (105) comprises many smart windows (101) connected together to form a single facade of the building (103). Alternatively, the smart window (101) may be formed as a single window or collection of windows in a wall of a building (103).

Figure 2:
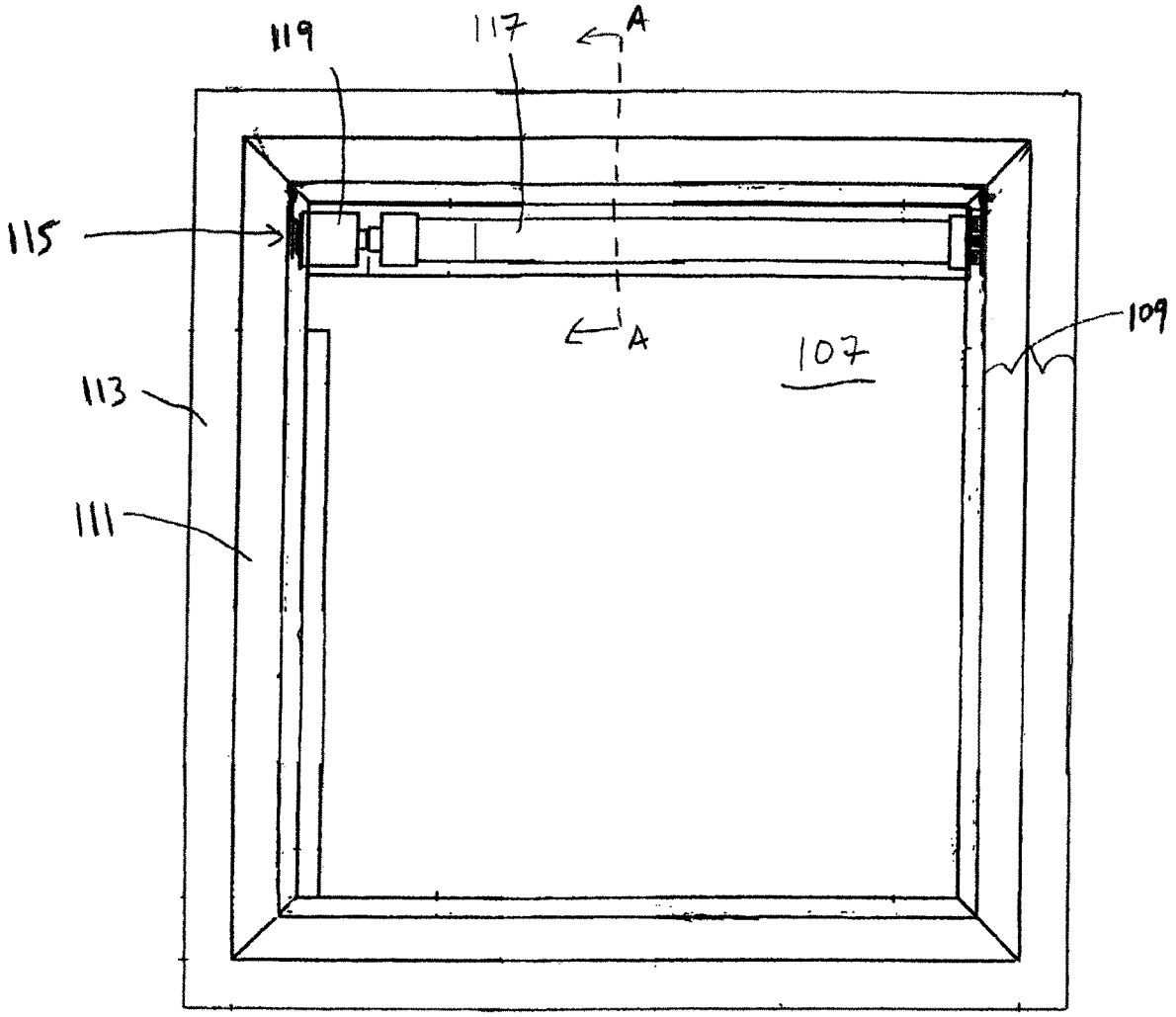
FIG. 2 depicts an embodiment of a smart window.
Figure 3:
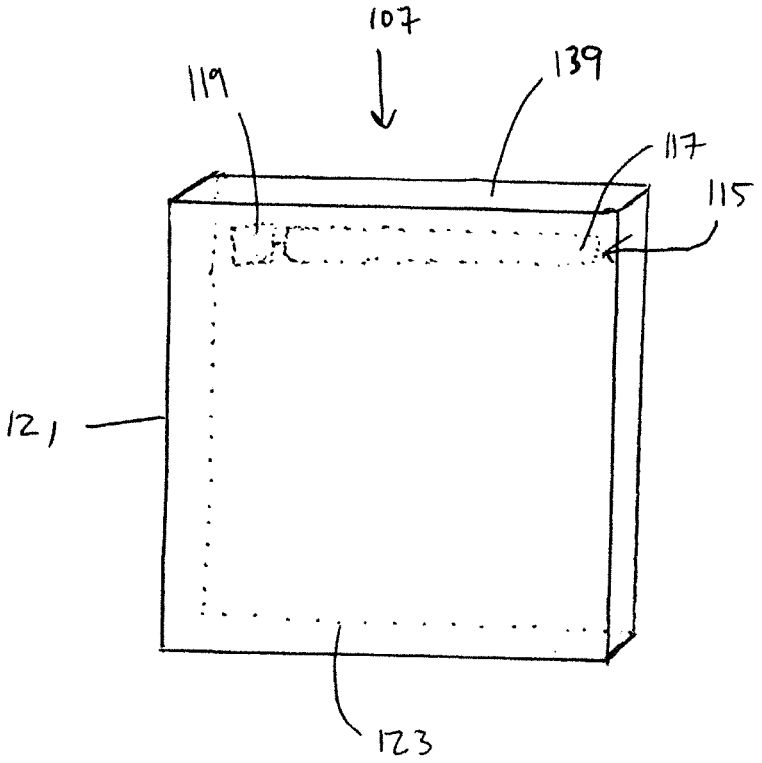
FIG. 3 depicts a perspective view of a glass portion of an embodiment of a smart window.

FIG. 2 provides an embodiment of a smart window (101), shown from the interior of a building (103). The smart window (101) includes a glass portion (107) that comprises, generally, at least one generally planar pane of glass. In some embodiments, the glass portion (107) includes more than one pane of glass (as shown in FIG. 3). Each pane of glass may be made from any glass material, or alternatively, from any material known in the art as suitable for use in a window, such as a transparent polymer. Additionally, a pane of glass may also be made from a laminate of various materials or may be coated with any material known in the industry to be used to treat glass, such as an antireflective coating or a tinting material. As shown in FIG. 3, the glass portion (107) generally also includes an air space (139) between an interior pane of glass (121) and an exterior pane of glass (123). Generally, the glass portion (107) will also include a motorized shade (115) including a motor (119) and a shade roll (117).

The glass portion (107) is surrounded by a frame portion (109), which is mounted or attached to the glass portion (107) at a periphery or perimeter of the glass portion (107). The frame portion (109) comprises a first subframe (111) and a second subframe (113). The frame portion (109) may be made of any material suitable for supporting the smart window (101). In this exemplary embodiment, the frame portion (109) is made principally from aluminum, but other materials such as wood, polymer, or other metals may be used alternatively or additionally to provide the frame portion (109) with desired characteristics or appearance. The frame portion (109) may also include various sealing materials, such as glazing materials and rubber materials, which each assist in holding the glass portion (107) to the frame portion (109) and ensuring that the smart window (101) is wind and water impermeable. Any component of the frame portion (109) may extend from any side of the glass portion (107), effectively surrounding the glass portion (107). Alternatively, any component of the frame portion (109) may only partially surround the glass portion (107). In another embodiment, the frame portion (109) surrounds the glass portion (107), but the first subframe (111) and the second subframe (113) only extend around some of the glass portion (107).

The glass portion (107) of the smart window (101) may also include a motorized shade (115) placed between the interior pane of glass (121) and the exterior pane of glass (123). The motorized shade may include a shade roll (117) and a motor (119). Further, the motorized shade may include a controller and a power source (not shown). The controller or power source may be separate from the shade roll (117) or motor (119), or may be integrated within either the shade roll (117) or the motor (119). The motor (119) may be integrated into the shade roll (117). The shade may be made from any material suitable for a shade roll (117), which is a roll of shade material attached at one end to a supporting tube (125). In an embodiment, the shade roll (117) comprises a polyester material with an acrylic foam backing, but other materials may be used as would be understood by a person of ordinary skill in the art. The supporting tube (125) may run through the center of the shade roll (117) from one end to the other. The supporting tube may be mounted on one side to a hanging system that is attached to the first subframe (111), and on the other side to the motor (119), which allows the motor to turn the supporting tube (125) to rotate the shade roll (117).

Figure 4:
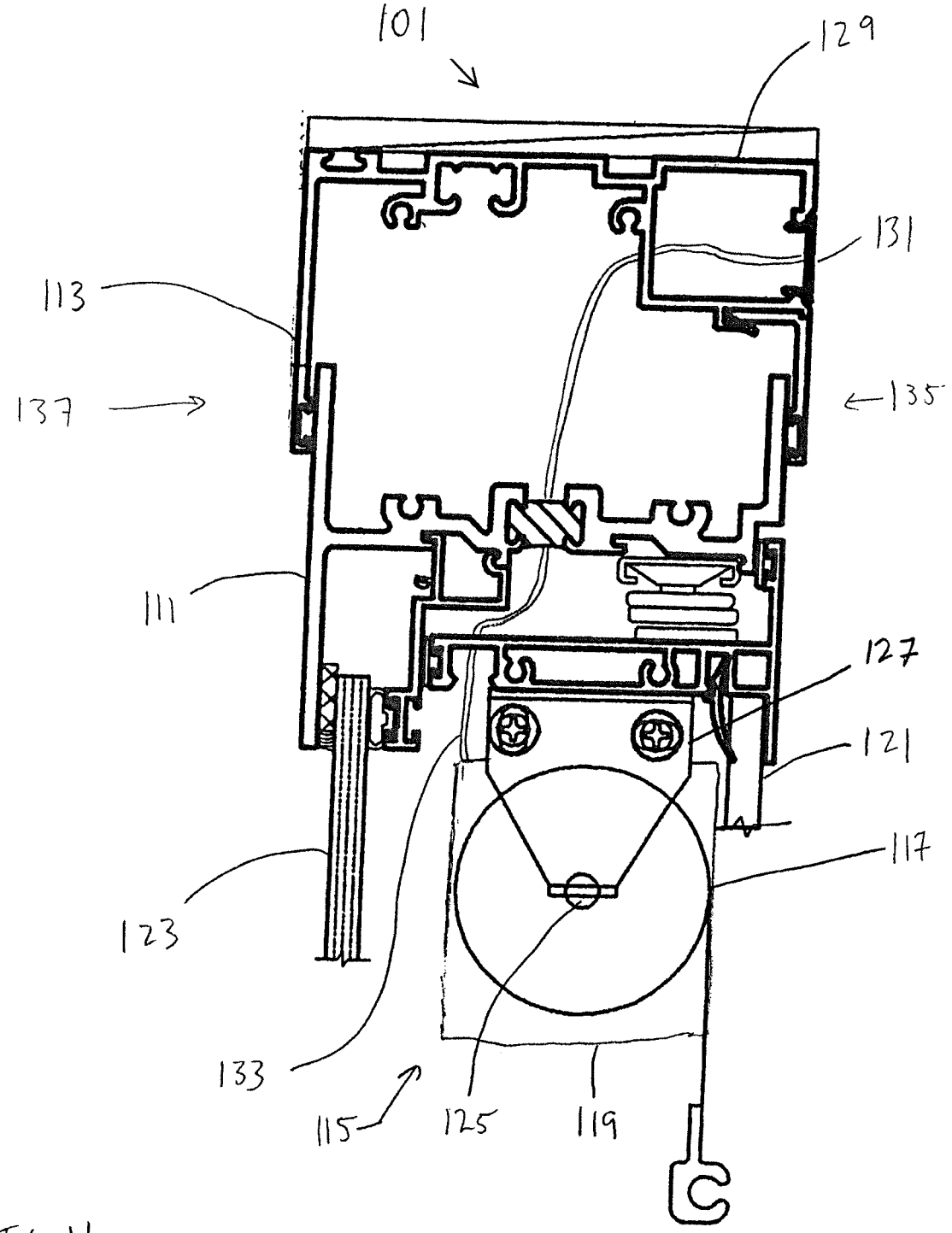
FIG. 4 depicts a cross-section of the embodiment of the smart window shown in FIG. 2 along line A-A.

FIG. 4 provides a cross-sectional view of the smart window (101) shown in FIG. 2 along the dashed line A-A. The right side (135) of the smart window (101) as shown in FIG. 4 generally faces towards the interior of the building (103), and the left side (137) of the smart window (101) faces towards the exterior of the building (103). An interior pane of glass (121) and an exterior pane of glass (123) are components of the glass portion (107) in the embodiment shown in FIG. 4. The glass portion (107) also includes the air space (139) in between these two panes of glass, as well as the motorized shade (115).

Also shown in FIG. 4 is the shade roll (117) and the related supporting tube (125). The supporting tube (125) may be attached at one end to a hanging system (127) and at the other end to the motor (119). The hanging system (127) allows the shade roll (117) to rotate without interfering with any other portion of the smart window (101). Accordingly, in the depicted embodiment, the hanging system (127) comprises two brackets, one formed to hold the motor (119) and the other formed to hold the shade roll (117). The motor is attached to the shade roll (117) at the supporting tube (125) so that the motor (119) may spin the shade roll (117).

The hanging system (127) ideally should mount the shade roll (117) far enough from the frame portion (109) so that when the shade roll (117) is completely open, and therefore at its biggest diameter, the shade roll (117) does not contact the frame portion (109). The shade roll (117) may spool and hang in either direction. In the case of the embodiment depicted in FIG. 4, the shade roll (117) hangs on the interior side of the shade roll (117) and spools towards the exterior of the building (137). In the embodiment depicted in FIG. 5, the shade roll (117) hangs on the exterior side of the shade roll (117) and spools towards the interior of the building (135). Any of the interior pane of glass (121) and the exterior pane of glass (123) may be hung on a hinge (not shown) to facilitate opening of the smart window (101) and access to the motorized shade (115).

FIG. 4 also shows some details of the first subframe (111) and second subframe (113) along the depth of the smart window (101). Each of the interior pane of glass (121) and the exterior pane of glass (123) may be attached to the first subframe (111). The first subframe (111) may be attached to the second subframe (113). In each case, the above-discussed components of the smart window (101) may be attached using any method known in the art. For example, components of the smart window (101) may be attached to each other using screws or bolts (not shown). Alternatively or additionally, the components of the smart window (101) may be attached to each other using a bonding material, such as an epoxy or glazing material known in the art (not shown). Further, seals of any type may be used to increase the wind and water resistance of the smart window (101). Flexible seals formed between the components of the smart window (101) may also give the smart window (101) some additional resistance to vibrations and bending fatigue. Components of the smart window (101) may alternatively be attached using press fit methods. For example, the first subframe (111) may be attached to the second subframe (113) by press fitting a section of the first subframe (111) into a section of the second subframe (113). In any case, the components of the smart window (101) may be assembled and attached using any technique known in the art.

The second subframe may include a wiring chase (129). The wiring chase (129) may be positioned internal to the second subframe (113). In other embodiments, the wiring chase (129) may be positioned external to the second subframe (113), positioned internal to the first subframe (111), or positioned external to the first subframe (111). In the embodiment depicted in FIG. 4, the wiring chase (129) is positioned internal to the second subframe (113) towards the interior side of the second subframe (113). This positioning allows any related motor wiring (133) to be located furthest into the interior of the building (103).

The wiring chase (129) may be used to route motor wires (133) from the motor (119) to a power source within the building (103). One or more openings may be provided within the wiring chase (129) to facilitate the connections of the motor wiring (133). The openings may be covered with a wiring chase cover (131). The wiring chase cover (131) may be made of any material, for example, a compliant material, such as a rubber or plastic material. The wiring chase (129) may extend around the entire glass portion (107) of the smart window (101) or may only extend around a portion of the glass portion (107). For example, in an embodiment, the wiring chase (129) only extends across the area of the frame portion (109) that is above the motorized shade (115).

In some embodiments, the openings within the wiring chase (129) are located such that adjacent smart windows (101) will have corresponding openings in the wiring chase (129) that allow motor wirings (133) to run from a wiring chase (129) in a first smart window (101) into a wiring chase (129) in an adjacent smart window (101). The adjacent smart window (101) may be vertically, horizontally, or diagonally adjacent, and the related openings in the wiring chase (129) may be formed in a corresponding manner between adjacent smart windows (101) to facilitate connections made from one smart window to the next. As a result, motor wiring (133) can extend from one wiring chase (129) to the next wiring chase (129) to consolidate the areas where each smart window (101) is connected into the building's (103) electrical grid.

Figure 5:
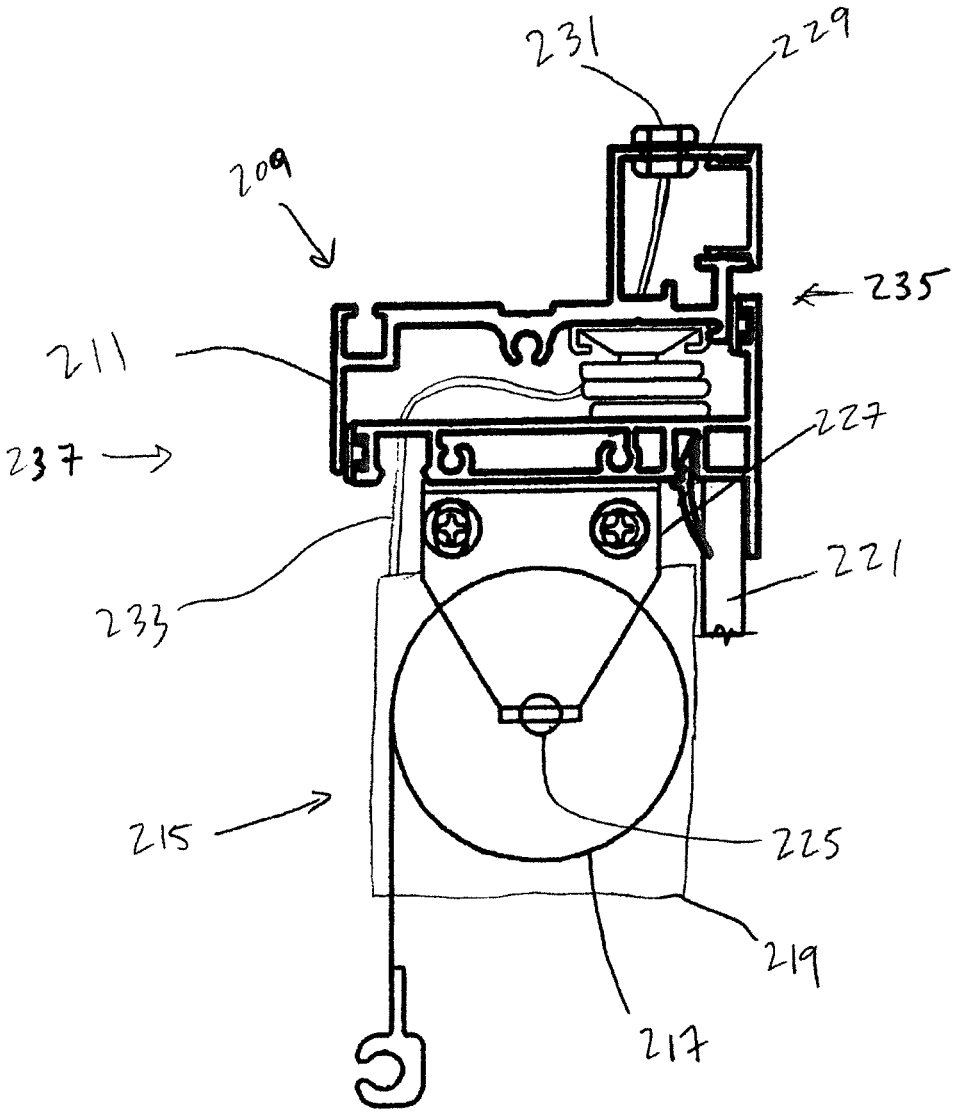
FIG. 5 depicts a cross-section of another embodiment of a smart window.

FIG. 5 shows an alternate embodiment of the smart window (101), where a first subframe (211), a motorized shade (215), and interior pane of glass (221) may be retrofitted onto an existing window to form a smart window (101). Typically, retrofitting an existing window would entail a process of installing a second pane of glass (221), a motorized shade (215), and an addition frame portion (209) to the existing window on the interior side of the existing window. Generally, the additional frame portion (209), motorized shade (215), and second pane of glass (221) would fit within the existing frame of the existing window. Alternatively, the retrofitting process may extend the frame of the existing window to make room for the retrofitted components.

In the embodiment depicted in FIG. 5, the motorized shade (215) includes a shade roll (217) attached to a hanging system (227). In this embodiment, only the first subframe (211) is provided, without any other subframe. Connected to the first subframe (211) is a wiring chase (229). The wiring chase (229) may be attached to the first subframe (211) using any method known in the art. Alternatively, as shown in FIG. 5, the wiring chase (229) may be integrally formed with the first subframe (211). The wiring chase (229) may be positioned internal or external to the first subframe (211). A motor wiring (233) may be positioned internal to the first subframe (211) and to the wiring chase (229). The wiring chase (229) may have at least one opening, and the at least one opening may be covered by a wiring chase cover (231).

Once assembled, the first subframe (211) may be attached to an existing exterior window. For example, the first subframe (211) may be attached to the frame of the existing window on the interior side of the existing window. As a result, the prior window will now include a motorized shade (215) and an interior pane of glass (221), boosting the efficiency and usability of the prior window being retrofitted. Alternatively, the various components of the smart window (101) may be assembled during installation and attached to the existing window without preassembly.

As a further alternative to attaching the first subframe (211) to the frame of the existing window, the first subframe (211) may be attached to the interior wall of the building (103) surrounding the existing window. In any case, the retrofitting process will add a second pane of glass (221) and a motorized shade (215) that is located between the glass of the existing window and the second pane of glass (221) to create a smart window (101).

Generally, the systems discussed herein will operate by providing a plurality of motorized shades within a plurality of windows in a variety of locations connected to primary control panels in each room, and to a master control panel within a single location. Such manner of control is, however, by no means required and the shades, windows, and other structures herein may operate independently. When working together, the motorized shades will generally communicate, via a network, with at least one of the primary control panels and with the master control panel. The primary control panels and master control panel may be for example, computers, electronics using computers, or mobile devices. The primary control panels and master control panel will generally have software thereon to control the operation of the motorized shades and may provide feedback specific to the current operating conditions of each motorized shade. Generally, a primary control panel will be located within a room and will control all of the motorized shades of windows in that room. This allows a user of the room to easily control the operation of all motorized shades in that room. For example, in a room designed to be used for conferences, a user may use a primary control panel to close all of the motorized blinds, which would darken the room, before giving a presentation on a screen in the room. Further, the master control panel may be used to a building administrator to close all of the window blinds at a given time. For example, a building administrator may use a master control panel to close all of the motorized window shades to place the building in a "lock down" mode in response to a threat being made to the building or its occupants. In an embodiment, the primary control panel and the master control panel are mobile devices. In this embodiment, a user is able to control the smart windows from their mobile device. Further, in some embodiments, each control panel is able to control any window in the building using the control panel's software. In this embodiment, the software on each control panel or mobile device is capable of giving or denying permission for a given user to control each smart window in the building. Further, a central server may be present to give individual users, mobile devices, or control panels permission to control each window in the building.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "planar" are purely geometric constructs and no real-world component is a true "planar" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

The invention claimed is:

1. A method of installing a retrofitted smart window on an interior side of a previously installed pane of glass, the method comprising:

providing a smart window, the smart window comprising:

a frame portion including a wiring chase positioned internal to the frame portion; and a glass portion comprising:

a motorized shade, the motorized shade including a motor, a motor wiring, and a shade roll; and a first pane of glass attached to the frame portion on an interior side of the smart window;

wherein the frame portion surrounds the glass portion, and wherein the motorized shade is attached to the frame portion between the first pane of glass and the previously installed pane of glass by a hanging system;

attaching the smart window to a frame of the previously installed pane of glass so that the motorized shade is located between the previously installed pane of glass and the first pane of glass; and connecting the motor wiring from the wiring chase to an electrical grid, wherein the motor wiring is positioned internal to the frame portion and the wiring chase.

2. The method of claim 1, the smart window further comprising a wiring chase cover, wherein the wiring chase includes at least one opening on a surface distal from the glass portion that is covered by the wiring chase cover.

3. The method of claim 1, wherein the first pane of glass is made from a laminated material.

4. The method of claim 1, wherein the frame portion comprises a first subframe and a second subframe; wherein the second subframe surrounds the first subframe, and wherein the wiring chase is positioned at least partially internal to the second subframe portion.

5. The method of claim 1, wherein the first pane of glass and the second pane of glass are both attached to the first subframe.

6. The method of claim 1 further comprises:

providing a second smart window comprising:

a second frame portion including a second wiring chase positioned internal to the second frame portion; and a second glass portion comprising:

a second motorized shade, the second motorized shade including a second motor, a second motor wiring, and a second shade roll;

a third pane of glass attached to the second frame portion on an exterior side of the second smart window; and a fourth pane of glass attached to the second frame portion on an interior side of the second smart window wherein the second frame portion surrounds the second glass portion, wherein the second motorized shade is attached to the second frame portion between the third pane of glass and the fourth pane of glass by a second hanging system, and wherein the second motor wiring is positioned internal to the second frame portion and the second wiring chase, wherein the smart window is installed in a building at a position adjacent to the second smart window, and wherein the motor wiring is positioned internal to the wiring chase and the second wiring chase.

7. The method of claim 1, the smart window further comprising a control panel configured to control the motorized shade and the second motorized shade simultaneously.

* * * * *